US007267094B2

(12) United States Patent
Tawarada et al.

(10) Patent No.: US 7,267,094 B2
(45) Date of Patent: Sep. 11, 2007

(54) LUBRICATION SYSTEM OF SMALL VEHICLE ENGINE

(75) Inventors: Yuichi Tawarada, Saitama (JP); Eiko Shiozaki, Saitama (JP); Isamu Takahashi, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/527,383

(22) Filed: Sep. 27, 2006

(65) Prior Publication Data

US 2007/0074698 A1 Apr. 5, 2007

(30) Foreign Application Priority Data

Sep. 30, 2005 (JP) ..... 2005-287126

(51) Int. Cl.
*F01M 11/02* (2006.01)
*F01M 3/04* (2006.01)

(52) U.S. Cl. ..... 123/196 M; 123/196 CP

(58) Field of Classification Search ..... 123/196 R, 123/196 CP, 196 M
See application file for complete search history.

(56) References Cited

U.S. PATENT DOCUMENTS 7,100,562 B2 * 9/2006 Terada et al. ..... 123/195 R
2004/0069260 A1 * 4/2004 Fujikubo ..... 123/90.31
2004/0069266 A1 * 4/2004 Fujikubo ..... 123/196 R

FOREIGN PATENT DOCUMENTS

JP 2004-100630 A 4/2004

* cited by examiner

*Primary Examiner*—Hai Nguyen
(74) *Attorney, Agent, or Firm*—Birch, Stewart, Kolasch & Birch, LLP

(57) ABSTRACT

A lubrication system of a vehicle engine wherein a cylinder head has a head side oil passage disposed at one end thereof along the axis of a crankshaft. A lower case of a crankcase is provided with a supply source side oil passage communicating with an oil supply source and extending parallel to the axis of the crankshaft and a branched oil passage guiding oil to the head side oil passage which branches from the supply source side oil passage and extends upwardly. An upper case side oil passage extending vertically to communicate with a head side oil passage is provided at one end of an upper case along the axis of the crankshaft. A communication passage communicating the upper end of a branched oil passage is provided in a lower case in a position inwardly from the upper case side oil passage along the axis of the crankshaft.

20 Claims, 14 Drawing Sheets

LUBRICATION SYSTEM OF SMALL VEHICLE ENGINE

CROSS-REFERENCE TO RELATED APPLICATION

The present application claims priority under 35 U.S.C. §119 to Japanese Patent Application No. 2005-287126, filed Sep. 30, 2005, the entire contents of which are hereby incorporated by reference.

BACKGROUND OF THE INVENTION

1. Field of the Invention

The present invention relates to a lubrication system of a small vehicle engine wherein a crankcase having an upper case coupled to a cylinder barrel forming a cylinder bore and a lower case separably coupled thereto rotatably supports a crankshaft having an axis in the vehicle width direction, a cylinder head has at one end along the axis of the crankshaft a head side oil passage, and the lower case is provided with a supply source side oil passage communicating with an oil supply source and extended in parallel with the axis of the crankshaft and a branched oil passage guiding oil to the head side oil passage and branched from the supply source side oil passage to be erected upwardly.

2. Description of Background Art

There has been known in JP-A No. 2004-100630 a lubrication system wherein an oil passage communicating an oil filter and an oil cooler disposed on the front surface of a crankcase when an engine is mounted on a motorcycle is provided in a lower case of the crankcase along the axis of a crankshaft, and a branched oil passage branched from the oil passage guides oil to a cylinder head side.

The cylinder head is provided with a head side oil passage positioned at one end along the axis of the crankshaft. In the lubrication system disclosed in JP-A No. 2004-100630, the branched oil passage branched from the oil passage provided in the lower case is connected to the head side oil passage by an oil passage construction arranged in one plane orthogonal to the axis of the crankshaft on one end side along the axis of the crankshaft. To secure a space arranging the branched oil passage, the width of the lower case in the direction along the axis of the crankshaft needs to be set to be relatively large. The degree of freedom in arrangement of the body frame and the exhaust system mounted on a small vehicle is reduced and the bank angle is difficult to secure.

SUMMARY AND OBJECTS OF THE INVENTION

The present invention has been made in view of such circumstances and an object of the present invention is to provide a lubrication system of a small vehicle engine wherein the width of a lower case in the direction along the axis of a crankshaft can be set to be small.

To achieve the above object, according to a first aspect of the present invention, a lubrication system of a small vehicle engine wherein a crankcase having an upper case coupled to a cylinder barrel forming a cylinder bore and a lower case separably coupled thereto rotatably supports a crankshaft having an axis in the vehicle width direction, a cylinder head has a head side oil passage at one end thereof extending along the axis of the crankshaft, and the lower case is provided with a supply source side oil passage communicating with an oil supply source and extended in parallel with the axis of the crankshaft and a branched oil passage guiding oil to the head side oil passage and branched from the supply source side oil passage to be erected upwardly. An upper case side oil passage extends vertically to communicate with the head side oil passage is provided at one end of the upper case along the axis of the crankshaft. A communication passage communicating the upper end of the branched oil passage is provided in the lower case inwardly from the upper case side oil passage and extending along the axis of the crankshaft. The lower end of the upper case side oil passage is formed between coupled surfaces of the upper case and the lower case.

According to a second aspect of the present invention, a portion formed with the communication passage of the coupled surfaces of the upper case and the lower case is formed to be wider than other portions of the coupled surfaces, and a groove is formed between the coupled surfaces outwardly of the communication passage.

According to a third aspect of the present invention, a liquid gasket is applied onto the coupled surfaces of the upper case and the lower case outwardly of the groove.

An oil pump 121 of an embodiment corresponds to the oil supply source of the present invention and a sub-gallery 137 of the embodiment corresponds to the supply source side oil passage of the present invention.

Effects of the Invention

According to the first aspect of the present invention, the oil passage from the branched oil passage to the upper case side oil passage is offset from the inner side to the outer side along the axis of the crankshaft. The branched oil passage can be arranged inwardly from the lower end of the upper case side oil passage along the axis of the crankshaft. The width of the lower case in the direction along the axis of the crankshaft can be set to be relatively small. The degree of freedom in arrangement of the body frame and the exhaust system mounted on a small vehicle can be increased and the bank angle can be easily secured.

According to the second aspect of the present invention, the groove is arranged outwardly of the communication passage. The liquid sealability on the coupled surfaces of the lower case and the upper case can be further reliable.

According to the third aspect of the present invention, the projected liquid gasket is received by the groove to prevent the liquid gasket from entering into the communication passage.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

An embodiment of the present invention will be described below based on an embodiment of the present invention shown in the accompanying drawings.

Figure 1:
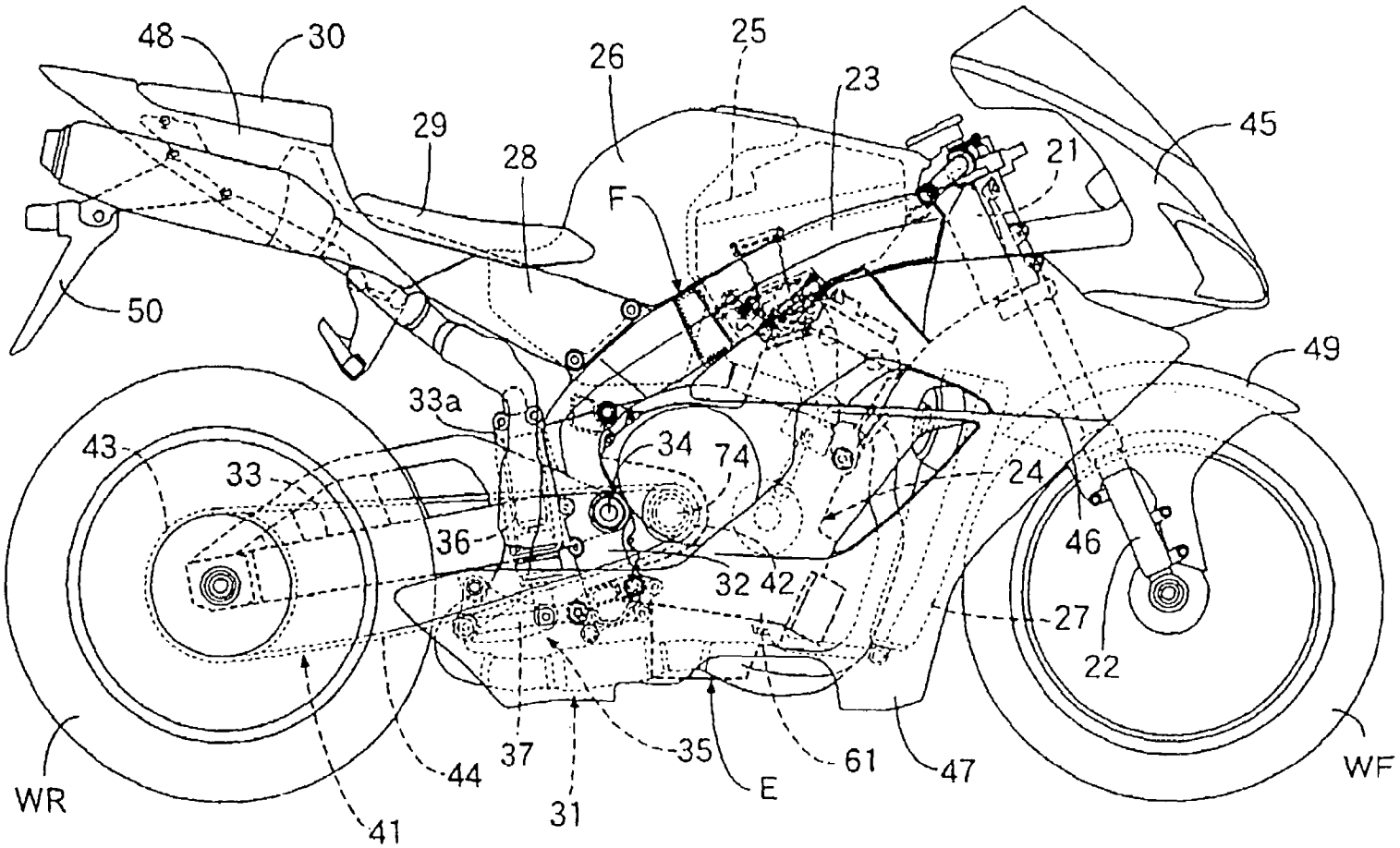
FIG. 1 is a side view of a motorcycle.

In FIG. 1, a head pipe 21 at the front end of a body frame F of a motorcycle as a small vehicle steerably supports a front fork 22 axially supporting a front wheel WF. An engine body 24 of a multicylinder, e.g., four-cylinder engine E arranged below a pair of right and left main frames 23 extended rearwardly and downwardly from the head pipe 21 is mounted on the body frame F.

An air cleaner 25 for cleaning air supplied to the engine E is arranged above the engine body 24 to be positioned rearwardly of the head pipe 21. A fuel tank 26 covering the rear part and the upper part of the air cleaner 25 is mounted on the both main frames 23. A radiator 27 is arranged forwardly of the engine body 24.

The rear parts of the both main frames 23 are coupled to a pair of right and left seat rails 28 extended rearwardly and upwardly. The seat rails 28 support a main seat 29 for seating a rider to the rear of the fuel tank 26. A pillion seat 30 for riding a pillion passenger is supported by the seat rails 28 in the position rearwardly away from the main seat 29.

An exhaust system 31 connected to the engine body 24 is extended downwardly from the front of the engine body 24 and is erected to be curved between a rear wheel WR and the engine body 24 from the lower side of the engine body 24 toward the right side of the vehicle body, thereby being extended rearwardly above the rear wheel WR.

The rear parts of the main frames 23 are connected to a pair of right and left pivot plates 32 extended downwardly. The front end of a swing arm 33 axially supporting the rear wheel WR at its rear end is swingably supported by the middle parts in the vertical direction of the both pivot plates 32 via an axis 34. A link mechanism 35 is provided between the lower parts of the both pivot plates 32 and the swing arm 33. The lower end of a rear cushion unit 36 whose upper end is coupled to a bracket 33*a* provided in the front part of the swing arm 33 is coupled to the front part of a link 37 constructing part of the link mechanism 35.

A crankcase 61 in the engine body 24 houses a transmission 72 (see later-described FIG. 3). The power from a countershaft 74 of the transmission 72 is transmitted to the rear wheel WR via chain transmission means 41.

The chain transmission means 41 has a driving sprocket 42 fixed to the countershaft 74, a driven sprocket 43 fixed to the rear wheel WR, and an endless chain 44 entrained about the sprockets 42 and 43, and is arranged on the left side of the engine E in the state that it is directed to the front of the traveling direction of the motorcycle.

The front of the head pipe 21 is covered by a front cowl 45 made of resin. Both sides of the front part of the vehicle body are covered by a center cowl 46 made of resin and joined to the front cowl 45. A lower cowl 47 made of resin and covering the engine body 24 from both sides is connected to the center cowl 46. The rear parts of the seat rails 28 are covered by a rear cowl 48.

A front fender 49 covering the upper side of the front wheel WF is attached to the front fork 22. A rear fender 50 covering the rear wheel WR from above is attached to the seat rails 28.

Figure 2:
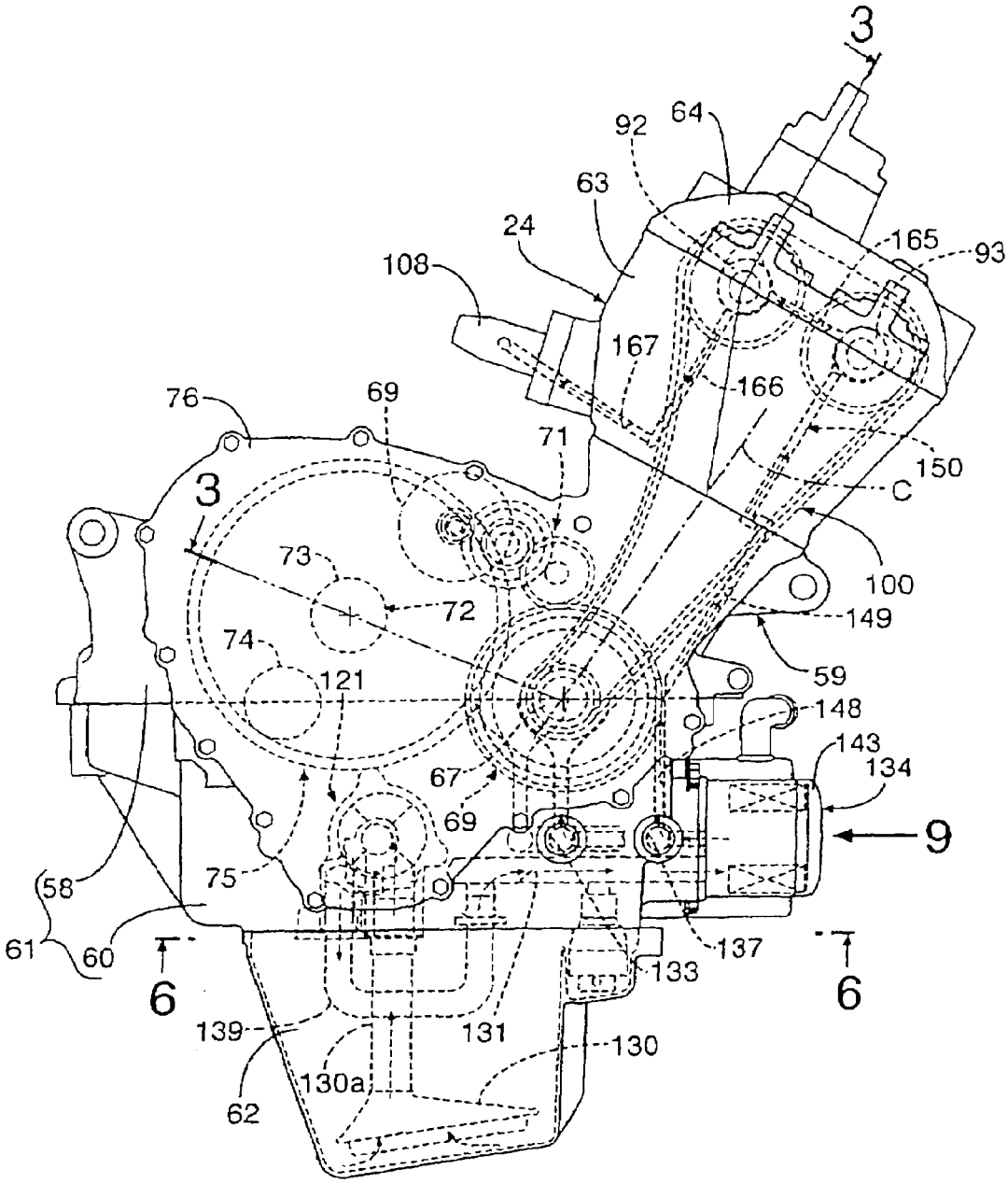
FIG. 2 is a side view of an engine.
Figure 3:
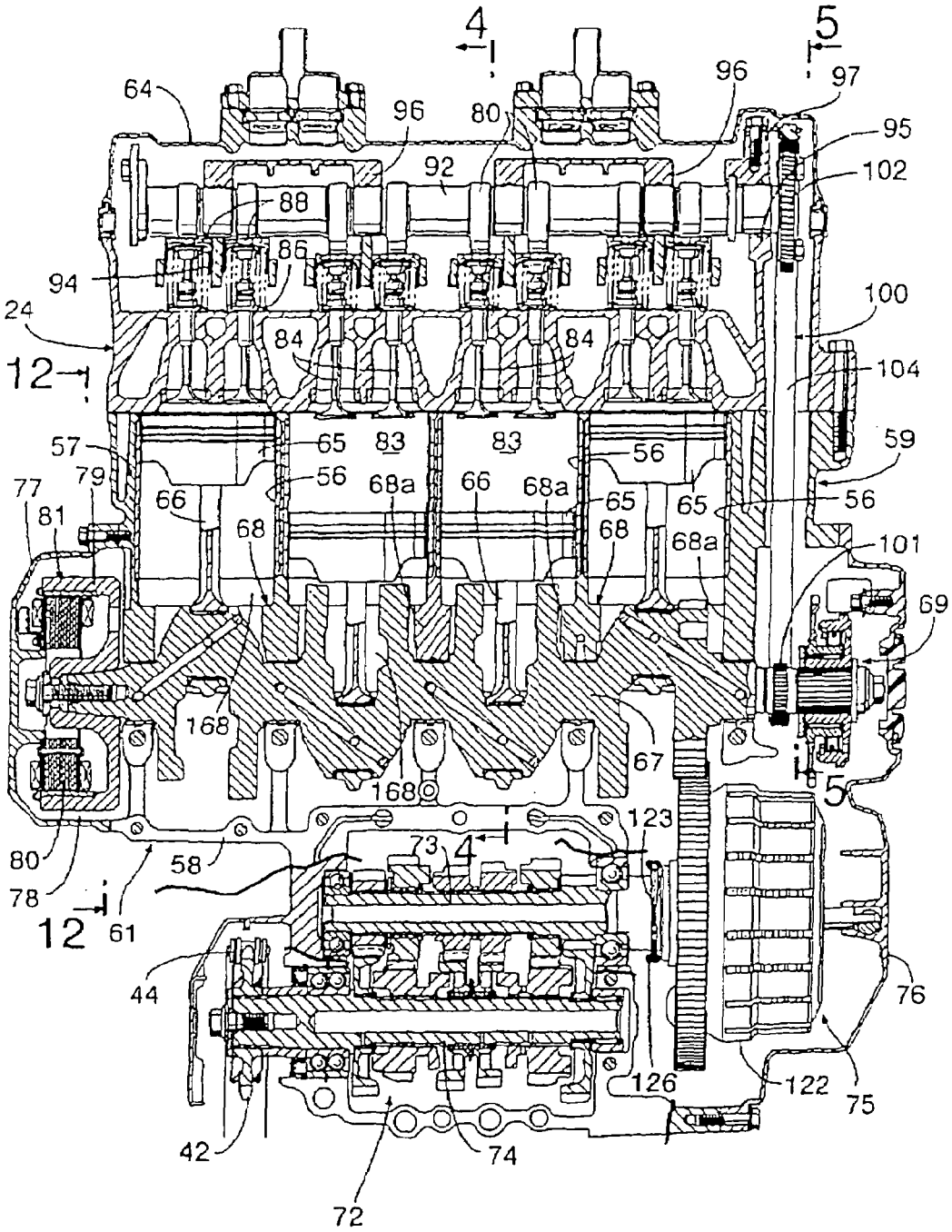
FIG. 3 is a cross-sectional view taken along line 3-3 of FIG. 2.

In FIGS. 2 and 3, the engine body 24 has a cylinder axis C tilted forwardly and upwardly, is mounted on the body frame F, and has a cylinder block 59 integrally having a cylinder barrel 57 provided with four cylinder bores 56 in series and an upper case 58 joined to the lower part of the cylinder barrel 57, a lower case 60 constructing the crankcase 61 in cooperation with the upper case 58 and coupled to the lower part of the cylinder block 59, an oil pan 62 coupled to the lower part of the lower case 60, that is, the lower part of the crankcase 61, a cylinder head 63 coupled to the upper part of the cylinder block 59, and a head cover 64 coupled to the upper part of the cylinder head 63.

A crankshaft 67 having an axis in the body width direction is coupled to pistons 65 slidingly fitted in the cylinder bores 56 via connecting rods 66. The crankshafts 67 are rotatably supported by plural crank journal walls 68 provided in the crankcase 61. The crank journal walls 68 have upper walls 68*a* provided on the upper case 58 side mutually coupled to lower walls 68*b* provided on the lower case 60 side.

One end of the crankshaft 67 protruded from the crank journal wall 68 on one side (in this embodiment, the right side along the traveling direction of the motorcycle) in the axial direction of the crankshaft 67 is fitted with an overrunning clutch 69. The overrunning clutch 69 has been known and inputs to the crankshaft 67 a rotation power from a start motor 70 (see FIG. 2) having a rotation axis in parallel with the crankshaft 67 and attached to the upper case 58 of the crankcase 61 in the engine body 24. A start gear transmission mechanism 71 is provided between the start motor 70 and the overrunning clutch 69.

An output of the crankshaft 67 is gear-shifted by the transmission 72 to be transmitted to the rear wheel as a driving wheel. The transmission 72 has a gear train having plural selectively-established gears between a main shaft 73 having an axis in parallel with the crankshaft 67 and rotatably supported by the upper case 58 of the crankcase 61 and a countershaft 74 having an axis in parallel with the main shaft 73 and rotatably supported between the upper case 58 and the lower case 60. The driving sprocket 42 constructing part of the chain transmission means 41 is fixed to an end of the countershaft 74 protruded from the crankcase 61.

One end of the main shaft 73 is fitted with a start clutch 75 interposed between the crankshaft 67 and the main shaft 73. When the start clutch 75 brought into the connected state according to the gear-shift operation of the rider, a power from the crankshaft 67 is transmitted to the main shaft 73.

The overrunning clutch 69 and the start clutch 75 are arranged in the positions protruded from the side walls of the cylinder block 59 and the lower case 60 (in this embodiment, the side walls on the right side toward the front of the traveling direction of the motorcycle) on one side along the axis of the crankshaft 67. A cover 76 covering the overrunning clutch 69 and the start clutch 75 is fastened to the side walls of the cylinder block 59 and the lower case 60.

Noting FIG. 3, a generator chamber 78 formed between the side wall of the cylinder block 59 on the other side along the axis of the crankshaft 67 and a generator cover 77 fastened to the cylinder block 59 is protruded into the other end of the crankshaft 67. A rotor 79 is fixed to the other end of the crankshaft 67 in the generator chamber 78. A stator 80 surrounded by the rotor 79 is fixed to the inner surface of the generator cover 77. The rotor 79 and the stator 80 construct a generator 81.

Figure 4:
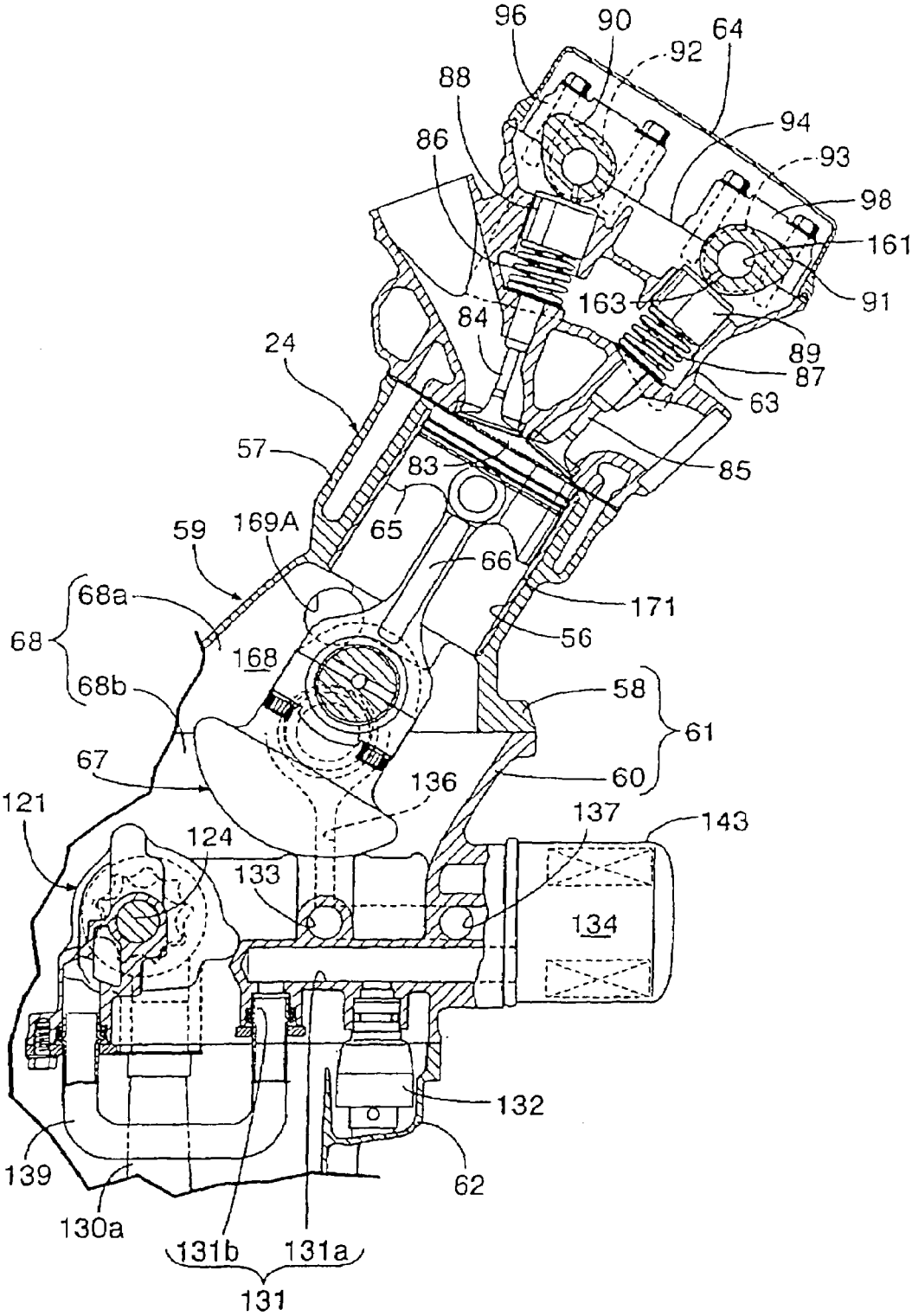
FIG. 4 is a cross-sectional view taken along line 4-4 of FIG. 3.

With FIG. 4, combustion chambers 83 facing the top parts of the pistons 65 are formed between the cylinder barrel 57 of the cylinder block 59 and the cylinder head 63. A pair of intake valves 84 and a pair of exhaust valves 85 are disposed in each of the combustion chambers 83 in the cylinder head 63 to be opened and closed. The intake valves 84 and the exhaust valves 85 are spring-exerted in the closed valve direction by valve springs 86 and 87.

Lifters 88 brought into contact with the top parts of the intake valves 84 are slidingly fitted in the cylinder heads 63 in the direction along the axis of the opened and closed operation of the intake valves 84. Lifters 89 brought into contact with the top parts of the exhaust valves 85 are slidingly fitted in the cylinder heads 63 in the direction along the axis of the opened and closed operation of the exhaust valves 85.

Intake side cams 90 are slidingly contacted with the lifters 88 from the opposite side of the intake valves 84. Exhaust side cams 91 are slidingly contacted with the lifters 89 from the opposite side of the exhaust valves 85. The intake side cams 90 are integral with an intake side cam shaft 92. The exhaust side cams 91 are integral with an exhaust side cam shaft 93.

The cylinder head 63 is integrally provided with the cam journal walls 94 arranged in the positions corresponding to the combustion chambers 83, which is common to the intake side cam shaft 92 and the exhaust side cam shaft 93 and a cam journal wall 95 arranged on one end side in the axial direction of the both cam shafts 92 and 93, which is common to the intake side cam shaft 92 and the exhaust side cam shaft 93. The intake side cam shaft 92 is rotatably supported by cam holders 96 and 97 fastened to the cam journal walls 94 and 95 and the cam journal walls 94 and 95. The exhaust side cam shaft 93 is rotatably supported by cam holders 98 and 97 fastened to the cam journal walls 94 and 95 and the cam journal walls 94 and 95.

Figure 5:
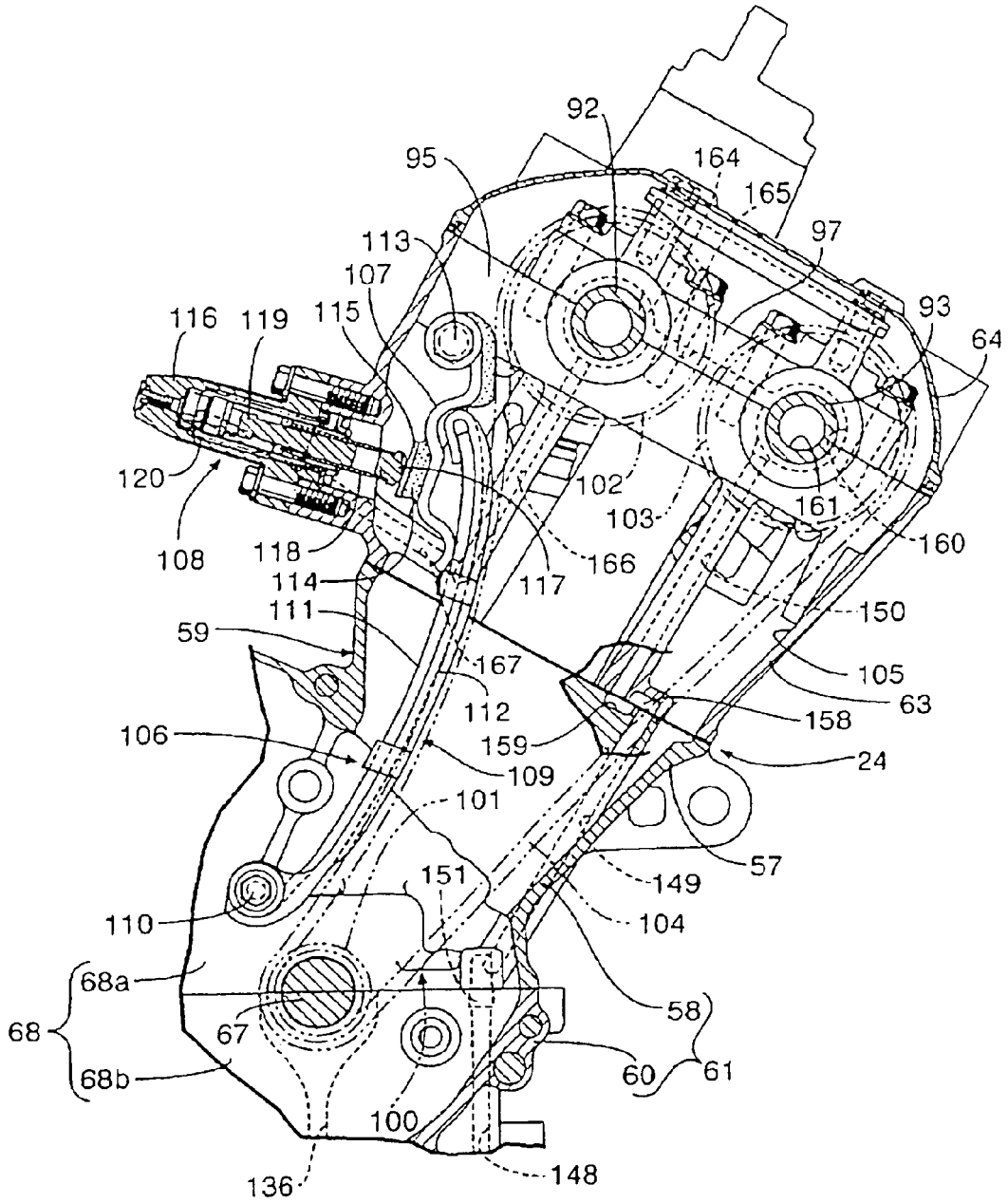
FIG. 5 is a cross-sectional view taken along line 5-5 of FIG. 3.

With FIG. 5, the rotation power of the crankshaft 67 is speed-reduced to ½ by a timing transmission device 100 to be transmitted to the intake side cam shaft 92 and the exhaust side cam shaft 93.

The timing transmission device 100 has a driving sprocket 101 fixed to the crankshaft 67 between the crank journal wall 68 and the overrunning clutch 69 on one end side in the axial direction of the crankshaft 67, a driven sprocket 102 fixed to one end of the intake side cam shaft 92, a driven sprocket 103 fixed to one end of the exhaust side cam shaft 93, and an endless cam chain 104 entrained about the sprockets 101, 102, and 103. The driving sprocket 101 and the lower part of the cam chain 104 are housed between the cylinder block 59 and the cover 76. The upper part of the cam chain 104 is housed in a cam chain chamber 105 provided in the cylinder head 63 to be driven.

The loosening side of the cam chain 104, that is, the cam chain 104 between the driving sprocket 101 and the driven sprocket 102 is given a fixed tension force by a chain tensioner device 109 having a tensioner arm 106, a control arm 107, and a tensioner lifter 108.

The tensioner arm 106 has a tensioner arm body 111 swingably supported by the cylinder block 59 via a first pivot 110 near the driving sprocket 101, and a shoe 112 made of resin and attached to the tensioner arm body 111 to be slidingly contacted with the outer surface on the loosening side of the cam chain 104. The tensioner arm body 111 is formed in a belt shape by a spring steel to be curved into an arch toward the outer surface on the loosening side of the cam chain 104. The shoe 112 is formed to cover the front surface of the tensioner arm body 111.

The control arm 107 is formed by a spring steel as in the tensioner arm body 111 and has a base end swingably supported by the cylinder head 63 by a second pivot 113 near the driven sprocket 102. The swing end of the control arm 107 is brought into contact with the back surface of the swing end of the tensioner arm body 111. The back surface of the middle part of the control arm 107 is joined to a pressure receiving plate 115 via a cushion member 114 such as rubber. The tensioner lifter 108 is attached to the cylinder head 63 to exert the pressure receiving plate 115 to the tensioner arm 106 side.

The tensioner lifter 108 has been known and has a lifter case 116 fastened to the cylinder head 63, a hollow lifter rod 118 having at its edge a pressuring part 117 brought into contact with the pressure receiving plate 115 and unrotatably supported by the lifter case 116, a thread axis 119 threaded into the hollow part of the lifter rod 118, and a helical torsion spring 120 rotatably exerting the thread axis 119 in the lifter case 116 in the moving direction of the lifter rod 118.

The tensioner lifter 108 conversion-amplifies the torsional force of the helical torsion spring 120 to a thrust load by the thread axis 119. The lifter rod 118 is exerted to the control arm 107 side.

Figure 6:
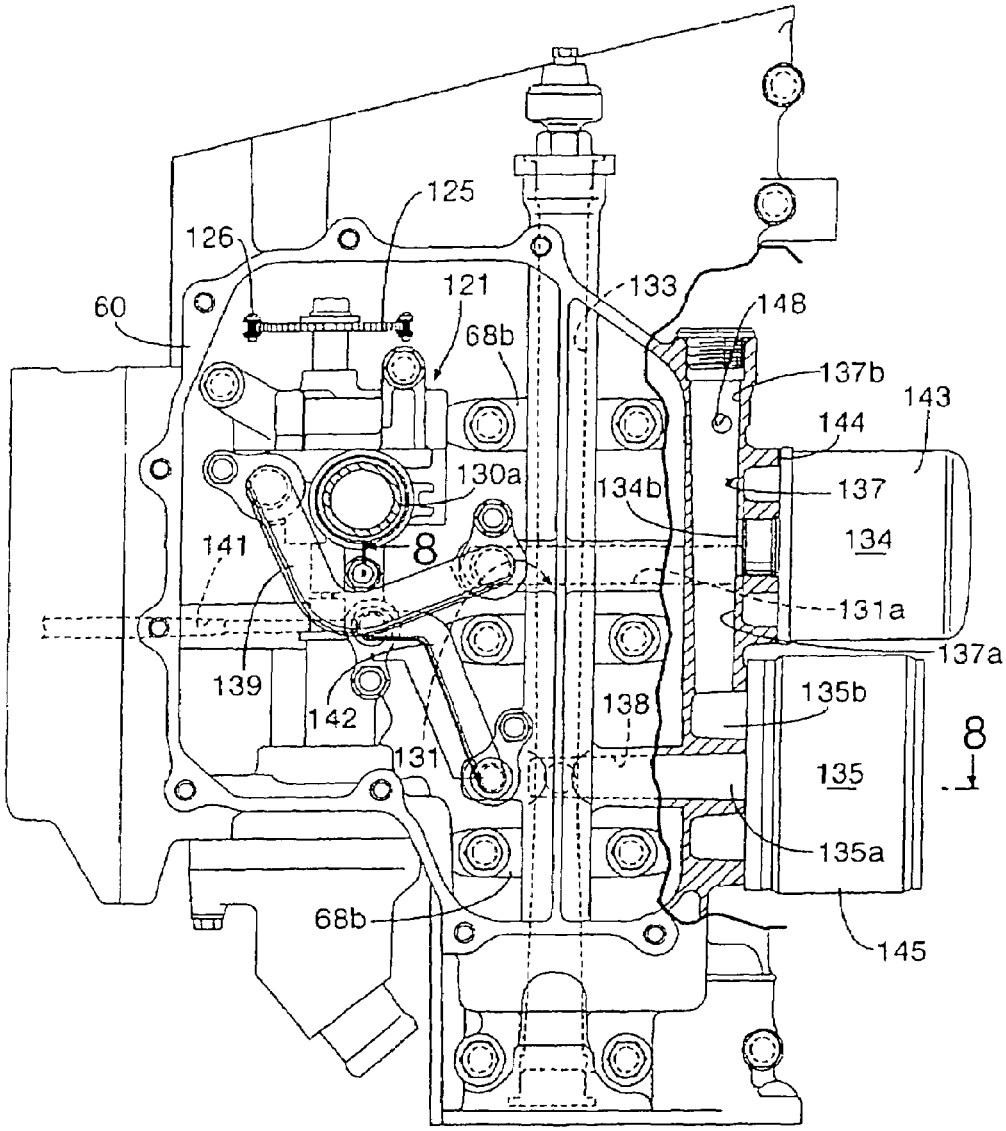
FIG. 6 is a cross-sectional view taken along line 6-6 of FIG. 2.

With FIG. 6, an oil pump 121 having a rotation axis in parallel with the crankshaft 67 is attached to the lower case 60 of the crankcase 61. An endless chain 126 is entrained about a sprocket 123 (see FIG. 3) engaged with a clutch housing 122 of the start clutch 75 so as not to be relatively rotated and a sprocket 125 fixed to an rotation axis 124 of the oil pump 121.

Figure 7:
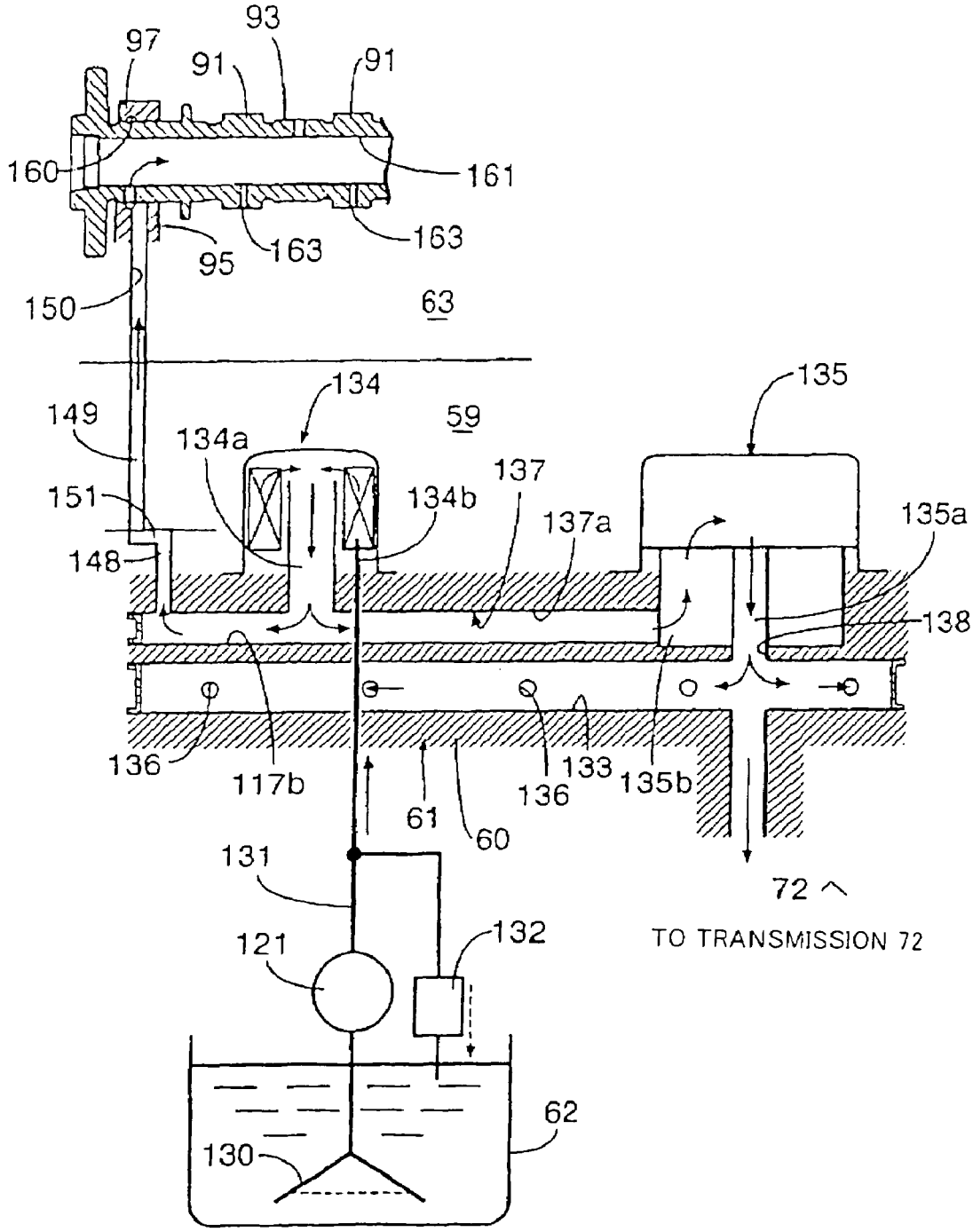
FIG. 7 is a diagram showing an oil supply system from an oil pump to a main gallery and a sub-gallery.

With FIG. 7, oil in the oil pan 62 is pumped by the oil pump 121 via an oil strainer 130 and is discharged from the oil pump 121 to a discharge passage 131 provided in the lower case 60. A relief valve 132 is interposed between the discharge passage 131 and the oil pan 62. The oil pressure of the discharge passage 131 is maintained to be constant.

Oil is supplied from a main gallery 133 provided in the lower case 60 of the crankcase 61 to the lubrication part between the crank journal walls 68 and the crankshaft 67 and the transmission 72. The main gallery 133 is connected to the discharge port of the oil pump 121 via an oil filter 134 and an oil cooler 135. Passages 136 guiding oil to the lubrication part between the crank journal walls 68 and the crankshaft 67 are provided in the lower case 60 to communicate with the main gallery 133.

The lower case 60 of the crankcase 61 is provided with a sub-gallery 137 connected to an outlet 134*a* of the oil filter 134 in parallel with the main gallery 133 to guide oil to the cylinder head 63 side.

The sub-gallery 137 has a first passage part 137*a* linearly extended to communicate the outlet 134*a* of the oil filter 134 with the oil cooler 135 and a second passage part 137*b* linearly extended in the opposite direction of the first passage part 137*a*. The discharge passage 131 is connected to an inlet 134*b* of the oil filter 134. Oil admitted from the first passage part 137*a* communicating with the outlet 134*a* of the oil filter 134 into the oil cooler 135 is guided to the main gallery 133 via a communication passage 138 provided in the lower case 60 to coaxially communicate with an outlet 135*b* provided in the center part of the oil cooler 135.

The sub-gallery 137 and the main gallery 133 communicating with an outlet 135*b* of the oil cooler 135 have an axis in parallel with the axis of the crankshaft 67 and are provided in the lower case 60 of the crankcase 61. The discharge passage 131 has a passage part 131*a* provided in the lower case 60 so that one end thereof communicates with the inlet 134*b* of the filter 134 of the oil cooler 135, and a passage part 131*b* formed by a connection pipe 139 connecting the other end of the passage part 131 a and the discharge port of the oil pump 121. The passage part 131*a* has an axis in a plane orthogonal to the main gallery 133 and the sub-gallery 137 and is arranged below the main gallery 133 and the sub-gallery 137. The connection pipe 139 of the oil strainer 130 is bent to bypass a pipe part 130*a* connected to the intake port of the oil pump 121.

Figure 8:
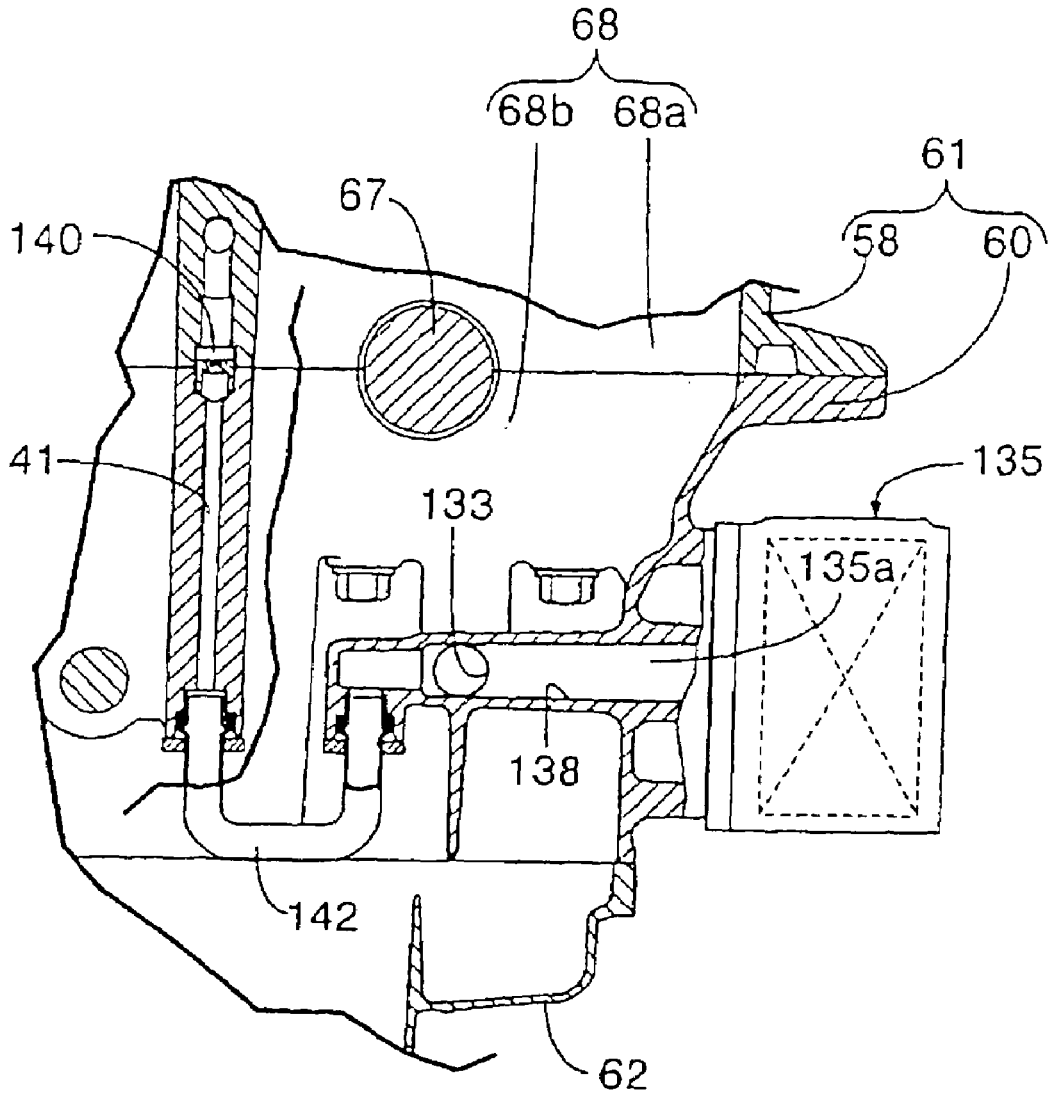
FIG. 8 is a cross-sectional view taken along line 8-8 of FIG. 6.

In FIG. 8, a transmission passage 141 having a measuring nozzle 140 interposed in its middle part is provided in the upper case 58 and the lower case 60 of the crankcase 61 so as to open one end thereof near the oil pump 121. One end of the transmission passage 141 is connected to the communication passage 138 via a connection pipe 142. The connection pipe 142 is bent so as to cross in three dimensions the connection pipe 139 forming the passage part 131*b* of part of the discharge passage 131. The connection pipes 139 and 142 are integrally arranged to cross each other in three dimensions. The space for arranging other auxiliary equipment in the crankcase 61 can be secured.

Figure 9:
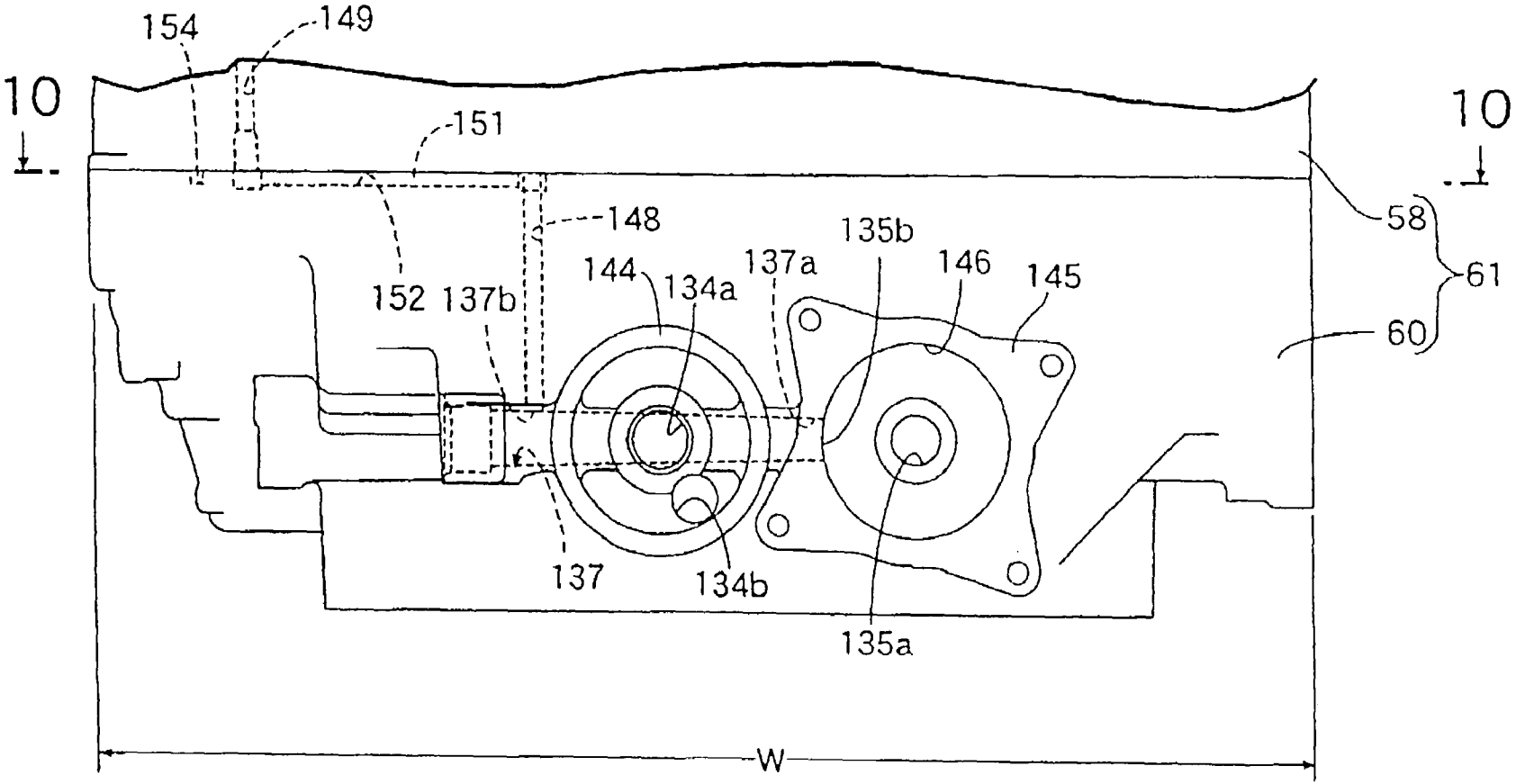
FIG. 9 is a diagram of a crankcase viewed in the direction of arrow 9 of FIG. 2.

In FIG. 9, the oil filter 134 and the oil cooler 135 are attached to the outer wall surface of the crankcase 61, in this embodiment, the outer wall surface of the front part of the lower case 60 in the traveling direction of the motorcycle.

The outer wall surface of the lower case 60 of the crankcase 61 is provided with a circular installation seat 144 for installing a housing 143 of the oil filter 134. The circular outlet 134*a* communicating with the sub-gallery 137 is arranged in the center part of the installation seat 144. The inlet 134*b* communicating with the discharge passage 131 is arranged in the installation seat 144 in the position deviated from the outlet 134*a*.

An installation seat 146 for installing a housing 145 of the oil cooler 135 is provided on the outer wall surface of the lower case 60 in the position adjacent the installation seat 144 so as to form a circular recess 147. The first passage part 137*a* in the sub-gallery 137 is opened to the inside surface of the circular recess 147. Its opening part is the inlet 135*b* of the oil cooler 135. An outlet 135*a* is opened to the center part of the circular recess 147. The outlet 135*a* communicates with the main gallery 133 via the communication passage 138.

A branched oil passage 148 erected upwardly from the second passage part 137*b* of the sub-gallery 137 between one end of the sub-gallery 137 along the axis of the crankshaft 67 and the oil filter 134 is provided in the lower case 60 of the crankcase 61. The branched oil passage 148 communicates with the lower end of an upper case side oil passage 149 provided in the upper case 58 and the cylinder barrel 57 to be extended to the cylinder head 63 side. The upper end of the upper case side oil passage 149 communicates with the lower end of a head side oil passage 150 provided in the cylinder head 63.

The upper case side oil passage 149 is tilted upwardly toward the front of the traveling direction of the motorcycle and is provided at one end along the axis of the crankshaft 67 in the cylinder block 59 having the upper case 58 integrally coupled to the cylinder barrel 57. The branched oil passage 148 provided in the lower case 60 is extended vertically inwardly from the upper case side oil passage 149 along the axis of the crankshaft 67. The upper end of the branched oil passage 148 communicates with the lower end of the upper case side oil passage 149 via a communication passage 151 formed between the coupled surfaces of the upper case 58 and the lower case 60.

Figure 10:
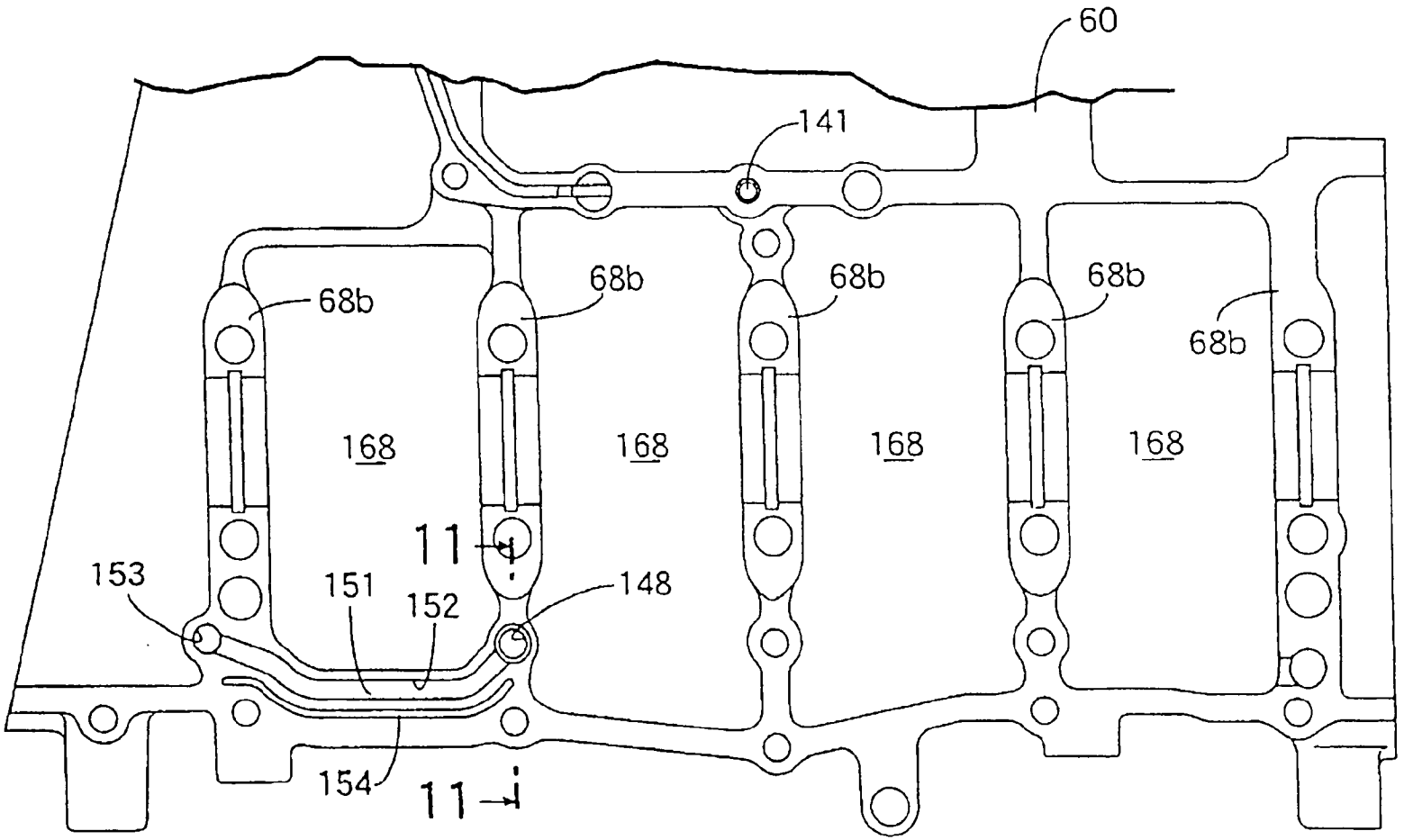
FIG. 10 is a plan view of a lower case viewed in the arrow direction taken along line 10-10 of FIG. 9.
Figure 11:
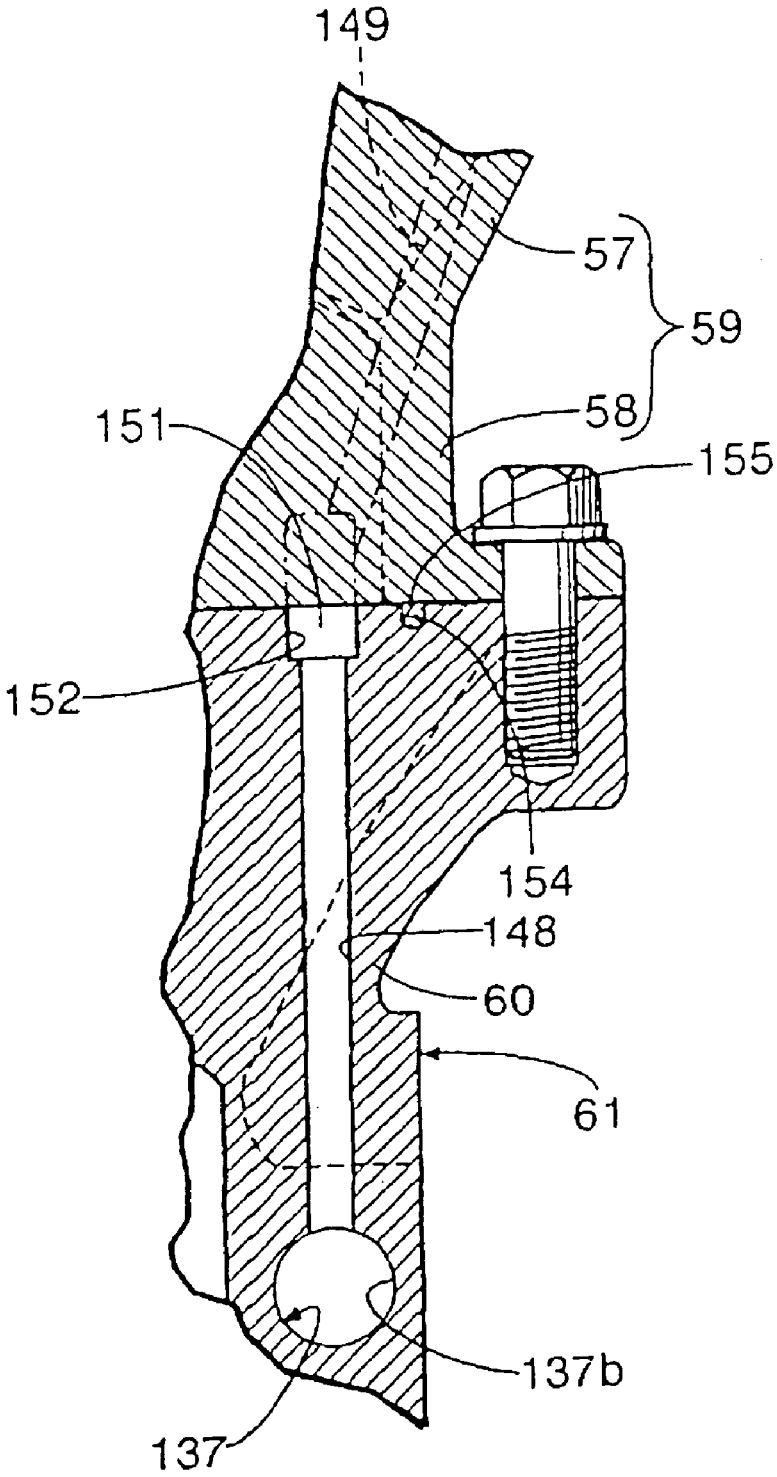
FIG. 11 is a cross-sectional view showing the coupled portions of an upper case and a lower case taken along line 11-11 of FIG. 10.

In FIGS. 10 and 11, to form the communication passage 151 between the coupled surfaces of the upper case 58 and the lower case 60, a communication groove 152 having one end opening the upper end of the branched oil passage 148 is provided on the coupled surface of the lower case 60 to the upper case 58 so as to arrange the other end outwardly from the branched oil passage 148 along the axis of the crankshaft 67. The other end of the communication groove 152 is formed with a circular communication recess 153 for communicating the upper case side oil passage 149 with it.

A portion formed with the communication passage 151 of the coupled surfaces of the upper case 58 and the lower case 60 is formed to be wider than other portions of the coupled surfaces. A groove 154 is formed outwardly of the communication passage 151 between the coupled surfaces of the upper case 58 and the lower case 60. In this embodiment, the groove 154 is formed on the coupled surface of the lower case 60 to the upper case 58.

The upper case 58 is coupled to the lower case 60 via a liquid gasket 155. The liquid gasket 155 is applied onto the coupled surfaces of the upper case 58 and the lower case 60 outwardly of the groove 154 in the portion provided with the groove 154.

The upper end of the upper case side oil passage 149 communicates with a recess 158 (see FIG. 5) provided on the coupled surface of the head cover 63 to the cylinder block 59. A recess 159 (see FIG. 5) communicating with the recess 158 is provided on the coupled surface of the cylinder block 59 to the cylinder head 63. The recess 159 communicates with the lower end of the head side oil passage 150. The lower end of the head side oil passage 150 is positioned inwardly from the upper end of the upper case side oil passage 149. The upper end of the upper case side oil passage 149 and the lower end of the head side oil passage 150 pass through the recesses 158 and 159, respectively. The upper end of the upper case side oil passage 149 communicates with the lower end of the head side oil passage 150.

Noting FIG. 5, the head side oil passage 150 is provided on the cam journal wall 95 on one end side along the axis of the crankshaft 67 of the plural cam journal walls 94 and 95 to be linearly extended. The cam journal wall 95 and the cam holder 97 fastened to the cam journal wall 95 are provided with a ring groove 160 surrounding the exhaust side camshaft 93. The upper end of the head side oil passage 150 is opened to the ring groove 160. As shown in FIG. 7, the exhaust side camshaft 93 axially has a lubrication oil passage 161 closed at both ends of the exhaust side cam shaft 93 and is provided with a communication hole 162 communicating the ring groove 160 with the lubrication oil passage 161 and lubrication oil holes 163 having an outer end opened to the side surfaces of the exhaust side cams 91 and having an inner end communicating with the lubrication oil passage 161. A ring groove, not shown, surrounding the exhaust side camshaft 93 is provided on the other cam journal walls 94 and the cam holders 98 to communicate with the lubrication oil passage 161.

Oil from the head side oil passage 150 is supplied to the lubrication oil passage 161 in the exhaust side camshaft 93. Oil is supplied from the lubrication oil passage 161 to the slide contact part of the exhaust side cams 91 and the lifters 89 and the slide contact part of the cam journal walls 94 and 95, the cam holders 98 and 97, and the exhaust side camshaft 93.

The ring groove 160 provided on the cam journal wall 95 and the cam holder 97 and surrounding the exhaust side camshaft 93, and a ring groove 164 provided on the cam journal wall 95 and the cam holder 97 and surrounding the intake side camshaft 92 communicate with each other by the communication groove 165 provided on at least one of the coupled surfaces of the cam journal wall 95 and the cam holder 97 (in this embodiment, the cam holder 97). A communication passage 166 communicating with the ring groove 164 is provided linearly on the cam journal wall 95 so as to be extended in parallel with the head side oil passage 150. The communication passage 166 communicates with a passage 167 provided in the lifter case 116 of the tensioner lifter 108.

Figure 12:
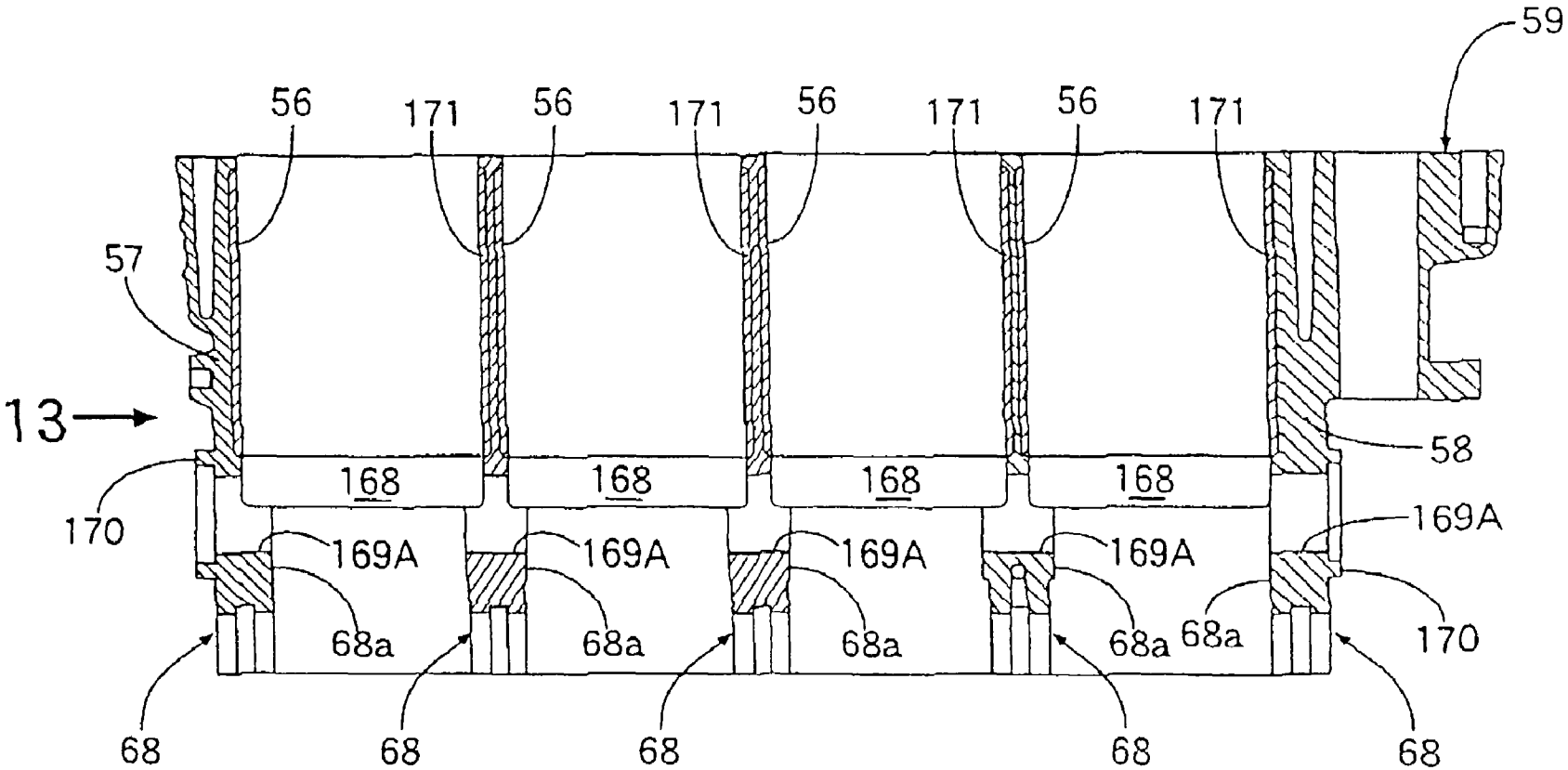
FIG. 12 is a longitudinal cross-sectional view of a cylinder block.

The crankcases 168 are formed between plural crank journal walls 68 rotatably supporting the crankshaft 67. As shown in FIG. 12, circular communication holes 169A are holed in the upper walls 68*a* of the crank journal walls 68 by machining to communicate the adjacent crankcases 168 with each other. In FIG. 12, the two communication holes 169A and 169A provided in the two right crank journal walls 68 are coaxial. The three coaxial communication holes 169A are holed in the three left crank journal walls 68 so as to have an axis in the position offset with respect to the two communication holes 169A.

A non-circular rib 170 joined endlessly by surrounding the circular communication hole 169A provided in the upper walls 68*a* is protruded from at least one surface of at least one part of the upper walls 68*a* of the crank journal walls 68. The cylinder block 69 integrally having the upper walls 68*a* is cast. It is difficult to provide a protrusion part on the side facing the cylinder bores 56 of the upper walls 68*a*. The ribs 170 and 170 are integrally protruded from the outer surfaces of the upper walls 68*a* and 68*a* arranged on the both outer sides along the axis of the crankshaft 67.

Figure 13:
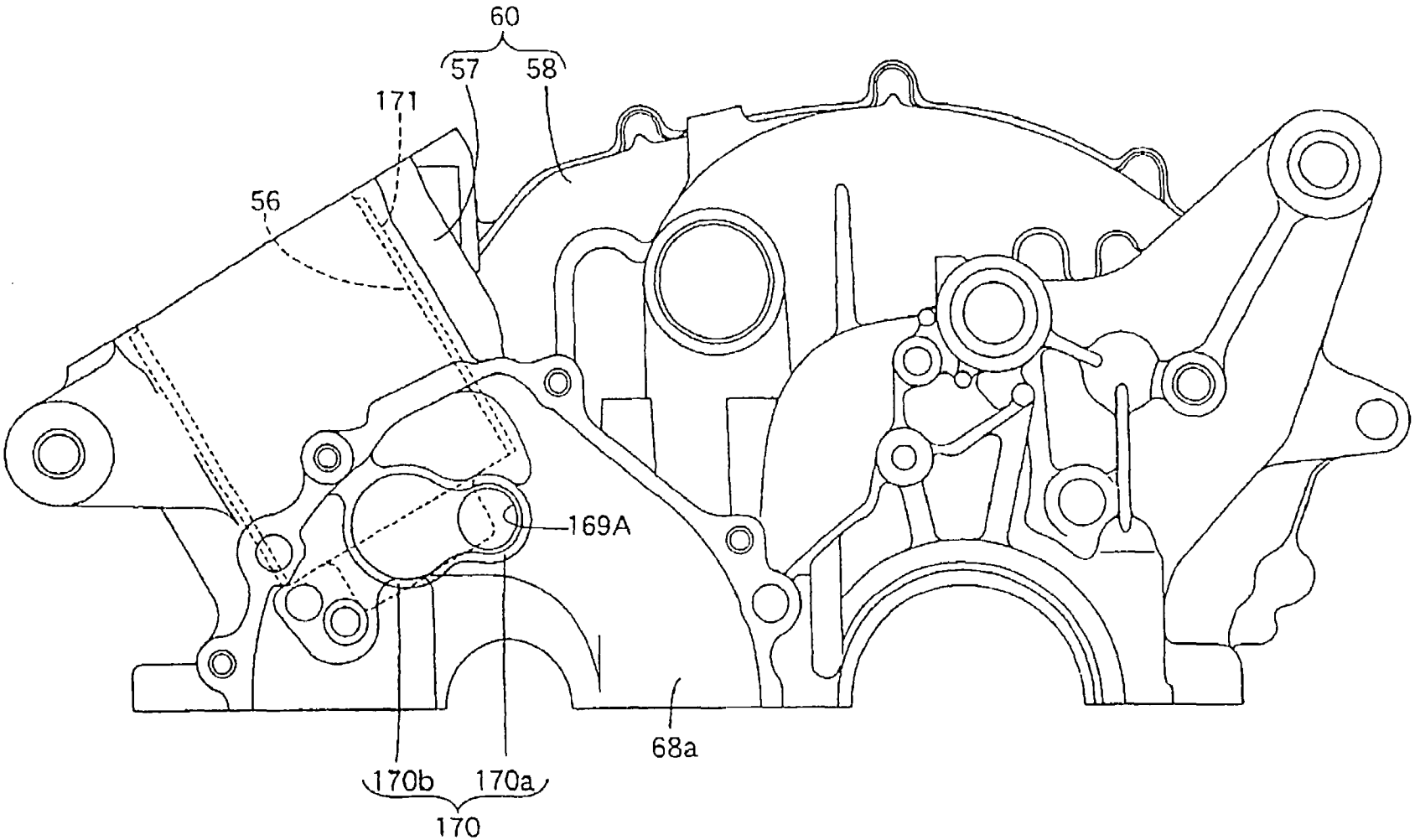
FIG. 13 is a diagram viewed in the direction of arrow 13 of FIG. 12.

As shown in FIG. 13, the rib 170 is formed in a potbellied shape in which a small circular part 170*a* and a large circular part 170*b* are joined to each other. The communication holes 169A are holed in the upper walls 68*a* so as to arrange an axis in the center of any one of the small circular part 170*a* and the large circular part 170*b*.

Figure 14:
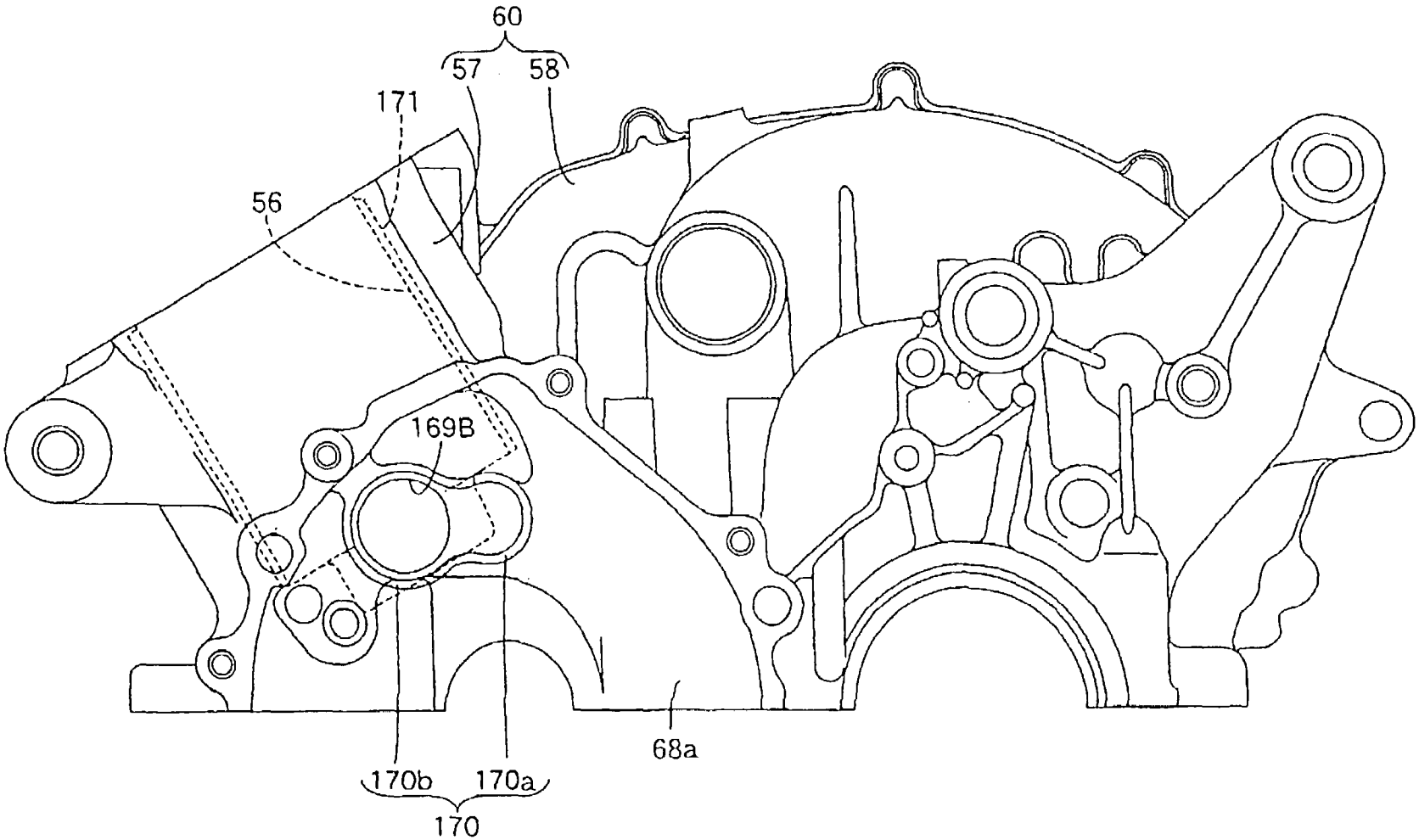
FIG. 14 is a diagram corresponding to FIG. 13 when the position of a communication hole is changed.

Liners 171 insert coupled to the cylinder block 59 so as to form the cylinder bores 56 are made of a material difficult to be holed by a boring tool. When the communication holes 169A are arranged in the positions deviated from the liners 171, as clarified in FIG. 13, the communication holes 169A may be arranged in the small circular parts 170*a* of the ribs 170. The liners 171 are made of a material easily holed by the boring tool. When communication holes 169B are holed so that the communication holes 169B are in part over the liner 171, as shown in FIG. 14, the communication holes 169B may be arranged in the large circular parts 170*b* of the ribs 170.

The operation of this embodiment will be described. The lower case 60 constructing the crankcase 61 together with the upper case 58 is provided with the supply source side oil passage 137 communicating with the oil pump 121 and extended in parallel with the axis of the crankshaft 67 and the branched oil passage 148 guiding oil to the head side oil passage 150 provided at one end of the cylinder head 63 along the axis of the crankshaft 67 and branched from the supply source side oil passage 137 to be erected upwardly. The upper case side oil passage 149 extended vertically to communicate with the head side oil passage 150 is provided at one end of the upper case 58 and the cylinder barrel 57 along the axis of the crankshaft 67. The upper end of the branched oil passage 148 provided in the lower case 60 inwardly from the upper case side oil passage 149 along the axis of the crankshaft 67 communicates with the lower end of the upper case side oil passage 149 via the communication passage 151 formed between the coupled surfaces of the upper case 58 and the lower case 60.

The oil passage from the branched oil passage 148 to the upper case side oil passage 149 is offset from the inner side to the outer side along the axis of the crankshaft 67. The branched oil passage 148 can be arranged inwardly from the lower end of the upper case side oil passage 149 along the axis of the crankshaft 67. A width W of the lower case 60 in the direction along the axis of the crankshaft 67 can be set to be relatively small. The degree of freedom in arrangement of the body frame F and the exhaust system 31 mounted on a small vehicle can be increased. The bank angle can be easily secured.

A portion formed with the communication passage 151 of the coupled surfaces of the upper case 58 and the lower case 60 is formed to be wider than other portions of the coupled surfaces. The groove 154 is formed between the coupled surfaces outwardly of the communication passage 151. The liquid sealability on the coupled surfaces of the lower case 60 and the upper case 58 can be further reliable.

The liquid gasket 155 is applied onto the coupled surfaces of the upper case 58 and the lower case 60 outwardly of the groove 154. The projected liquid gasket 155 is received by the groove 154 to prevent the liquid gasket 155 from entering into the communication passage 151.

The plural crank journal walls 68 rotatably supporting the crankshaft 67 are provided in the crankcase 61 to form the crankcases 168 between the crank journal walls 68. The communication hole 169A or 169B circularly formed by machining to communicate the adjacent crankcases 168 with each other is holed coaxially in the upper walls 68*a* of the crank journal walls 68. The non-circular ribs 170 and 170 joined endlessly by surrounding the circular communication hole 169A or 169B are integrally protruded from at least one surface of at least one part of the upper walls 68*a* of the crank journal walls 68, in this embodiment, from the outer surfaces of the upper walls 68*a* and 68*a* arranged on both outer sides along the axis of the crankshaft 67.

The rigidity of the upper walls 68*a* and 68*a* arranged on both outer sides along the axis of the crankshaft 67 in the crankcase 61 can be increased. The ribs 170 are formed in a non-circular shape to surround the circular communication hole 169A or 169B. Part of the periphery of at least the communication hole 169A or 169B can be spaced from the ribs 170. The substantial axial length of the communication hole 169A or 169B including the ribs 170 is shortened. The ventilation efficiency of air vented through the communication hole 169A or 169B can be increased. The pumping loss can be efficiently reduced.

The rib 170 is formed in a potbellied shape in which the small circular part 170*a* and the large circular part 170*b* are joined to each other. The position of the communication hole 169A or 169B in the rib 170 can be changed according to the requirement characteristic for each machine type. When the crankcase 61 is used for a machine type having a different requirement characteristic, the rigidity of the crankcase 61 can be secured and plural communication hole arrangement positions can be selected. The general versatility can be improved.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A lubrication system of a vehicle engine, comprising:

a crankcase having an upper case coupled to a cylinder barrel forming a cylinder bore and a lower case separably coupled thereto rotatably supporting a crankshaft having an axis in the vehicle width direction; and a cylinder head having ends along an axis of the crankshaft;

the cylinder head including a head side oil passage formed at one of the ends of the cylinder head;

the lower case including a supply source side oil passage communicating with an oil supply source and extending substantially parallel to the axis of the crankshaft, and a branched oil passage guiding oil to the head side oil passage and branching and extending upwardly from the supply source side oil passage, the upper case including an upper case side oil passage at one end thereof, the upper case side oil passage extending substantially parallel to and connecting to the head side oil passage in the cylinder head, and a communication passage communicating between an upper end of the branched oil passage provided in the lower case and the upper case side oil passage provided in the upper case, the communication passage extending along the axis of the crankshaft, wherein a lower end of the upper case side oil passage is formed between coupled surfaces of the upper case and the lower case.

2. The lubrication system of a vehicle engine according to claim 1, wherein a portion of the coupled surfaces of the upper case and the lower case formed with the communication passage is wider than other portions of the coupled surfaces, and a groove is formed between the coupled surfaces outwardly with respect to the communication passage.

3. The lubrication system of a vehicle engine according to claim 2, wherein a liquid gasket is applied in the groove formed between the coupled surfaces of the upper case and the lower case.

4. The lubrication system of a vehicle engine according to claim 1, wherein a liquid gasket is applied in a groove formed between the coupled surfaces of the upper case and the lower case.

5. The lubrication system of a vehicle engine according to claim 4, wherein the communication passage includes a curved portion.

6. The lubrication system of a vehicle engine according to claim 1, wherein a liquid gasket is applied in a groove formed in the surface of the lower case, the groove being disposed outwardly with respect to the communication passage and extending substantially parallel to the communication passage.

7. The lubrication system of a vehicle engine according to claim 1, wherein the oil supply source is an oil pump and the supply side oil passage is a sub-gallery.

8. The lubrication system of a vehicle engine according to claim 1, further comprising circular communication recess formed at a downstream end of the communication passage, the communication passage being formed in the lower case for communicating with the lower end of the upper case side oil passage formed in the upper case.

9. The lubrication system of a vehicle engine according to claim 1, wherein the communication passage is formed in the lower case.

10. The lubrication system of a vehicle engine according to claim 1, wherein the communication passage extends between an upper end of the branched oil passage formed in one of the lower walls of the lowercase and a circular communication recess formed in another of the lower walls of the lower case.

11. A lubrication system of a vehicle engine having a crankcase with an upper case coupled to a cylinder barrel forming a cylinder bore and a lower case separably coupled thereto rotatably supporting a crankshaft having an axis in the vehicle width direction and a cylinder head, the lubrication system of the vehicle engine comprising:

a cylinder head having ends along an axis of the crankshaft;

a head side oil passage formed at one of the ends of the cylinder head, the head side oil passage extending substantially perpendicular to an axis of the crankshaft;

a supply source side oil passage formed in the lower case to communicate with an oil supply source, the supply source side oil passage extending substantially parallel to the axis of the crankshaft;

a branched oil passage also formed in the lower case to guide oil to the head side oil passage, the branched oil passage branching from and extending upwardly from the supply source side oil passage;

an upper case side oil passage provided at one end of the upper case, the upper case side oil passage extending upwardly to connect with and communicate with the head side oil passage in the cylinder head;

a communication passage arranged in the lower case so as to extend substantially parallel to the axis of the crankshaft, the communication passage communicating from an upper end of the branched oil passage in the lower case to the upper case side oil passage in the upper case, wherein a lower end of the upper case side oil passage is formed between coupled surfaces of the upper case and the lower case.

12. The lubrication system of a vehicle engine according to claim 11, wherein a portion of the coupled surfaces of the upper case and the lower case formed with the communication passage is wider than other portions of the coupled surfaces, and a groove is formed between the coupled surfaces outwardly with respect to the communication passage.

13. The lubrication system of a vehicle engine according to claim 12 wherein a liquid gasket is applied in the groove formed between the coupled surfaces of the upper case and the lower case.

14. The lubrication system of a vehicle engine according to claim 11, wherein a liquid gasket is applied in a groove formed between the coupled surfaces of the upper case and the lower case.

15. The lubrication system of a vehicle engine according to claim 11, wherein a liquid gasket is applied in a groove formed in the surface of the lower case, the groove being disposed outwardly with respect to the communication passage and extending substantially parallel to the communication passage.

16. The lubrication system of a vehicle engine according to claim 11, further comprising circular communication recess formed at a downstream end of communication passage formed in the lower case for communicating with the lower end of the upper case side oil passage formed in the upper case.

17. The lubrication system of a vehicle engine according to claim 11, wherein the communication passage extends between an upper end of the branched oil passage formed in one of the lower walls of the lowercase and a circular communication recess formed in another of the lower walls of the lower case.

18. A lubrication system of a vehicle engine having a crankcase with an upper case coupled to a cylinder barrel forming a cylinder bore and a lower case separably coupled thereto rotatably supporting a crankshaft having an axis in the vehicle width direction and a cylinder head, the lubrication system of the vehicle engine comprising:

a head side oil passage is formed at one end of the cylinder head and extending substantially parallel to an axis of a cylinder bore;

a supply source side oil passage formed in the lower case to communicate with an oil supply source, the supply source side oil passage extending parallel with an axis of the crankshaft;

a branched oil passage also formed in the lower case to guide oil to the head side oil passage, the branched oil passage branching from and extending upwardly from the supply source side oil passage;

an upper case side oil passage extending substantially parallel to and connecting to the head side oil passage to communicate with the head side oil passage is provided at one end of the upper case;

a communication passage formed in the lower case for communicating from an upper end of the branched oil passage provided in the lower case to the upper case side oil passage provided in the upper case, the communication passage extending substantially parallel to the supply source side oil passage and substantially perpendicular to the branched oil passage, wherein a lower end of the upper case side oil passage is formed between coupled surfaces of the upper case and the lower case.

19. The lubrication system of a vehicle engine according to claim 18, wherein a portion of the coupled surfaces of the upper case and the lower case formed with the communication passage is wider than other portions of the coupled surfaces, and a groove is formed between the coupled surfaces outwardly with respect to the communication passage.

20. The lubrication system of a vehicle engine according to claim 19, wherein a liquid gasket is applied in the groove formed between the coupled surfaces of the upper case and the lower case.

* * * * *